137-13 SR
5/13/80 XR 4,202,180

United States Patent [19] [11] 4,202,180
Cox [45] May 13, 1980

[54] LIQUEFIED GAS SUPPLY SYSTEM

[75] Inventor: Frank H. Cox, Avon Lake, Ohio

[73] Assignee: The Scott & Fetzer Company, Cleveland, Ohio

[21] Appl. No.: 950,995

[22] Filed: Oct. 13, 1978

[51] Int. Cl.[2] ..... F17C 7/02
[52] U.S. Cl. ..... 62/50; 137/13
[58] Field of Search ..... 62/55, 50, 49, 45; 137/113

[56] References Cited

U.S. PATENT DOCUMENTS

| | | | |
|---|---|---|---|
| 2,402,187 | 6/1946 | Siver | 137/113 |
| 2,547,823 | 4/1951 | Josephian | 137/113 |
| 2,714,292 | 8/1955 | Strandwitz et al. | 137/113 |
| 2,768,640 | 10/1956 | Zimmer et al. | 137/113 |
| 2,775,980 | 1/1957 | Renaudie | 137/113 |
| 2,985,185 | 5/1961 | Morehead et al. | 137/113 |
| 3,241,328 | 3/1966 | Engel et al. | 62/55 |
| 3,322,135 | 5/1967 | Watson | 137/113 |
| 3,606,907 | 9/1971 | Stenberg | 137/113 |
| 3,643,677 | 2/1972 | Begleiter | 137/113 |
| 3,805,819 | 4/1974 | Etter | 137/113 |

*Primary Examiner*—Ronald C. Capossela
*Attorney, Agent, or Firm*—Pearne, Gordon, Sessions, McCoy & Granger

[57] ABSTRACT

In a liquefied gas supply system, a pressure switch senses pressure in the low-pressure supplied line of the system and opens a bypass valve to thereby bleed gas from the relatively warm reserve side and keep up the pressure in the supplied line while allowing the relatively cold service side to continue to contribute to the feed to the supplied line, but at the same time a flow limiting orifice limits cooling and controls temperature at the relatively cold service side by inhibiting the rate of absorption of heat-of-vaporization at the service side.

13 Claims, 10 Drawing Figures

LIQUEFIED GAS SUPPLY SYSTEM

Figure 1:
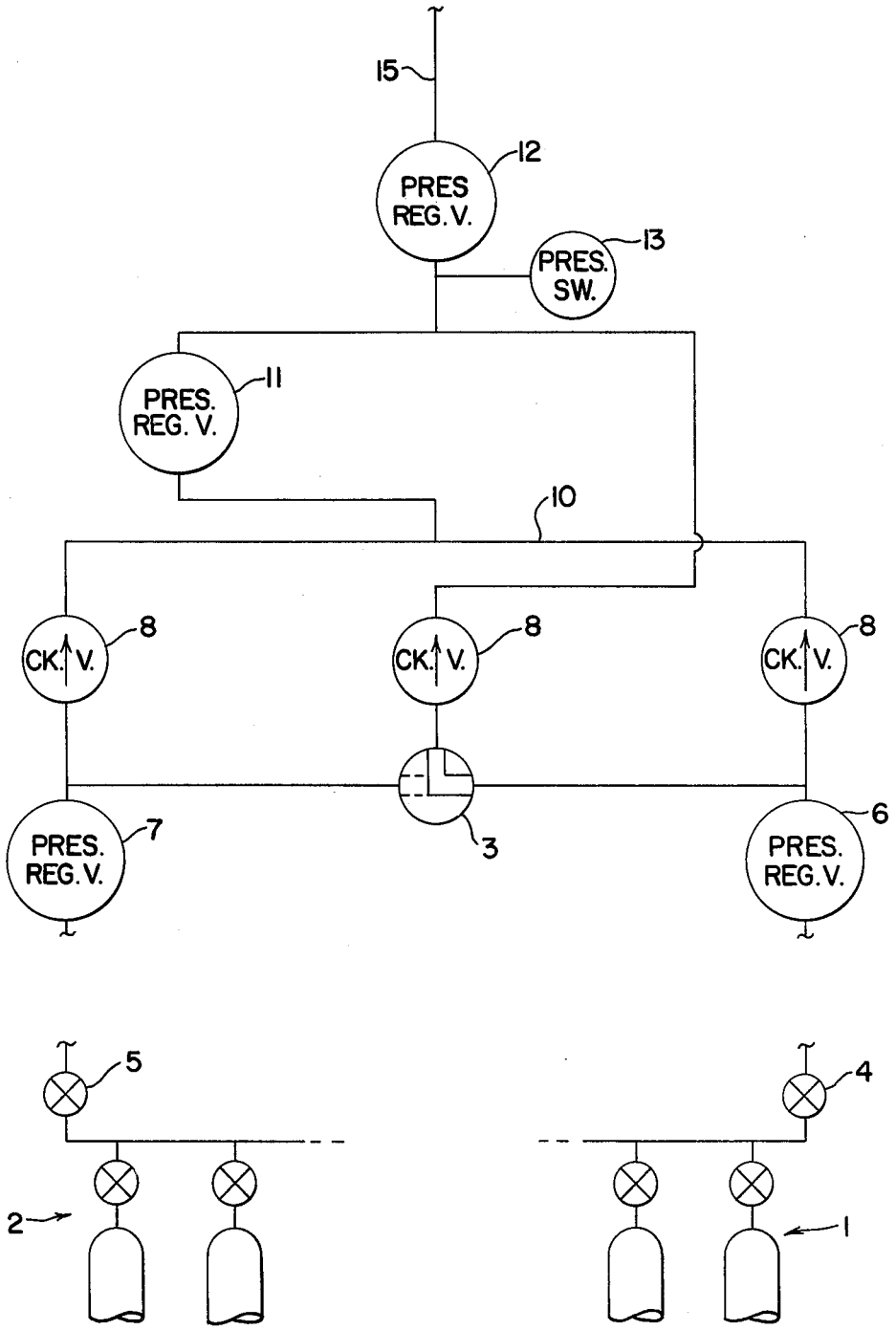
FIG. 1 (PRIOR ART)

This invention relates to differential changeover type gas control systems employed to control and regulate liquefied gases of the type which may be stored in the liguid state and under pressure within vessels (usually cylinders) at ambient temperatures without venting to atmosphere. This group of pressure-stored liquefied gases includes carbon dioxide, nitrous oxide, mapp gas, propane, and various other gases. The containers are pressure vessels capable of containing pressures at elevations sufficient to maintain the liquefied gas within the vessel at ambient temperature, with the liquid phase of the gas in equilibrium with the gaseous phase. The walls of such vessels are heat-conductive. Indeed, in order to sustain vaporization of the gas the vessel walls must absorb and transmit ambient heat at a sufficiently high rate rate to replace the heat which is absorbed by such vaporization. Vaporization occurs, of course, whenever gas is drawn from the vessel and the pressure equilibrium between liquid and gas phases is thereby disturbed.

The invention does not relate to the control and regulation of the "permanent" gases such as oxygen, argon, nitrogen, etc., which are stored in relatively low pressure cylinders in liquid form with provision for pressure relief through venting to the atmosphere. Such systems employ highly insulated storage vessels for excluding ambient heat and allowing the liquefied gas to remain at extremely low temperatures. The vessels in such systems are usually provided with vaporizers to produce desired levels of flow.

In differential changeover type gas control systems, both those for pressure-stored liquefied gases and those for permanent gases, one or more vessels (typically cylinders) are arranged in a so-called "service" bank and an equal number in a "reserve" bank. These are coupled through a central control which preferentially flows the "service" bank and, when it is exhausted, changes over automatically to the "reserve" bank and simultaneously actuates an alarm. The control also provides a means by which the function of the two banks, "service" and "reserve," may be reversed after the empty bank is replaced; thus, a new cycle is established. While there are many variations in details of design between various manufacturers, these controls are all very similar in their function and performance.

Serving as central supply systems, and regulating and dispensing the permanent gases to distribution systems in either medical or industrial applications, differential changeover type gas control systems adequately meet all requirements.

However, when differential changeover type gas control systems are employed to control and dispense the pressure-stored liquified gases (carbon dioxide, nitrous oxide, mapp gas, propane, etc.), serious problems arise. The provision of these gases in liquid form involves a series of stages of compression and cooling (removing the heat of compression). During the transition from liquid to gaseous state, an equivalent amount of heat must be replaced (supplying the heat of vaporization). Since the only source of heat normally available is that drawn from ambient air, and since utilization of this source of heat is almost completely dependent upon transfer through the cylinder walls with which the liquid content of the cylinder is in contact, the ability of the cylinder to provide vapor diminishes in direct proportion to reduction in the wetted surface as the liquid level drops. Also, since this source of heat becomes increasingly inadequate, the temperature of the liquid in the cylinder under sustained draw drops rapidly, further lowering the vapor rate of which the cylinder is capable.

In the standard automatic changeover controls presently available, no provision is made to cope with the above phenomenon. With the cylinder or cylinders in each bank full, the standard controls initially behave similarly to the manner in which they control the permanent gases. However, with the liquefied gases under moderate to high flows, the "service" bank loses its ability to supply sufficient vapor, and the control automatically changes over to "reserve" since the unused "reserve" can still supply full pressure. In the event of a protracted shutdown or substantially reduced flow, the "service" side, still containing a substantial amount of liquid, may warm up sufficiently to allow the "service" side to again overrule the lower differential pressure of the "reserve" and temporarily assume flow. Under any but relatively low flow demands, this resurgence of pressure in the "service" bank will not complete vaporization of the liquid in the "service" bank during the safe life of the "reserve" bank. Such circumstances frequently require that the "exhausted" "service" cylinders be replaced before their liquid contents have been completely utilized. Further, the user of the manifold system is usually unaware of the remaining unused residual product in the supposedly "exhausted" "service" bank at the time when they must be replaced to perform the "reserve" function after changeover. As a result, when flows required are in the moderate to high range in relation to the number of cylinders employed in the "service" and "reserve" banks, residual liquid returned to the supplier in the cylinders (liquid gas purchased but not utilized) frequently runs as high as 10% of the original content of the cylinder. In addition, when an alarm system is used with the standard controls, its behavior is frequently misleading, since it is actuated by a pressure switch which will indicate an empty condition when the "service" side fails even though substantial liquid may remain in the "service" cylinders or banks.

In most controls available today, the changeover function is generally accomplished by differential pressure setting of two regulators, with reversible connections being such that the lower setting is associated with the "reserve" side. The maximum flow rate of the unit is substantially higher during the period when flow is provided by the service side than is possible after changeover to reserve.

The present invention overcomes the foregoing problems. Pressure remains essentially steady under high flow demands. Maximum flow rate is high regardless of whether flow is being provided by the service side or primarily by the reserve side. Flow rates from 50 to 70% greater than standard systems are obtained for a given manifold size, thus substantially reducing manifold cost in the initial purchase of a manifold and control system to meet a given flow rate.

Using standard components, the system of the invention, designed for example to utilize nitrous oxide or carbon dioxide, can provide an average flow rate even under constant withdrawal of 60 to 80 cubic feet per cylinder per hour, entirely eliminate all liquid residual, and then reduce residual vapor content to less than 2% of the original product purchased. Comparable increases in withdrawal rates are accomplished with various liquefied fuel gases and other liquefied gases. In the case of acetylene gas, a somewhat different situation exists; i.e. the gas is chemically absorbed by acetone under pressure. The basic withdrawal rate limitation (1/7th of cylinder contents per hour for each cylinder) is created by the rate at which the gas may be freed without carrying the acetone out of the cylinder with the gas. However, the result of application of the invention parallels the results obtainable with the liquefied gases.

Figure 2:
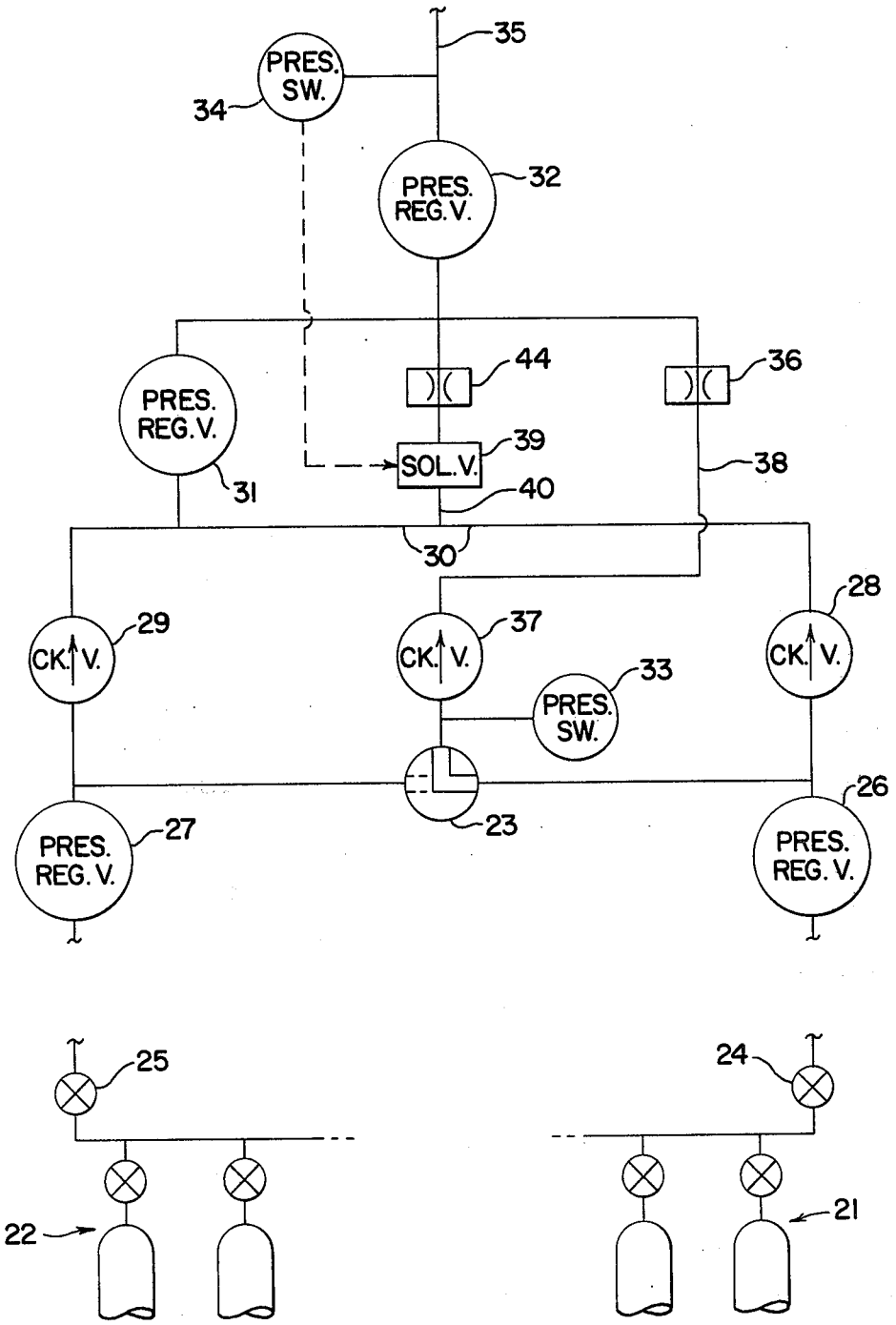
Figure 3:
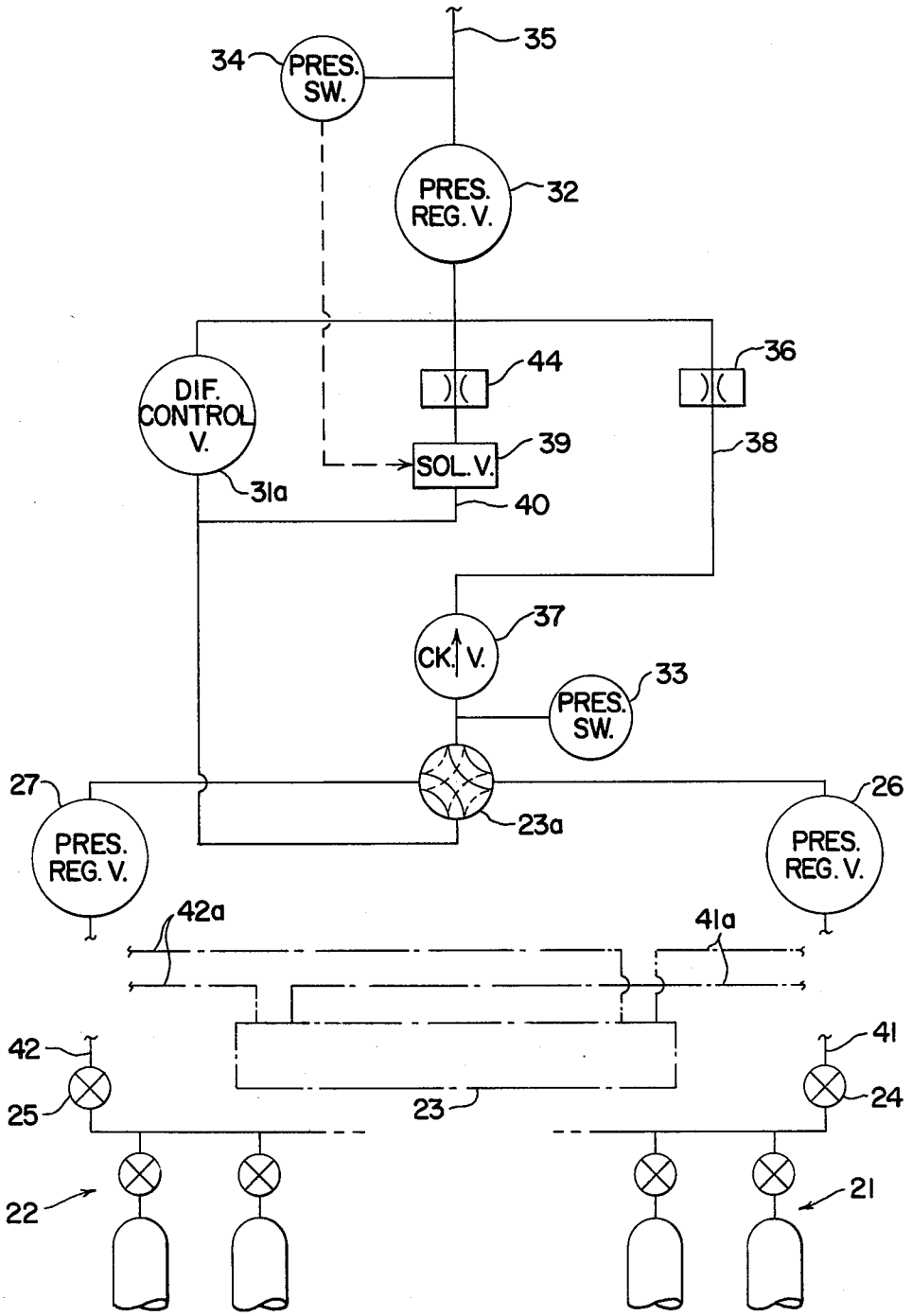
Figure 4:
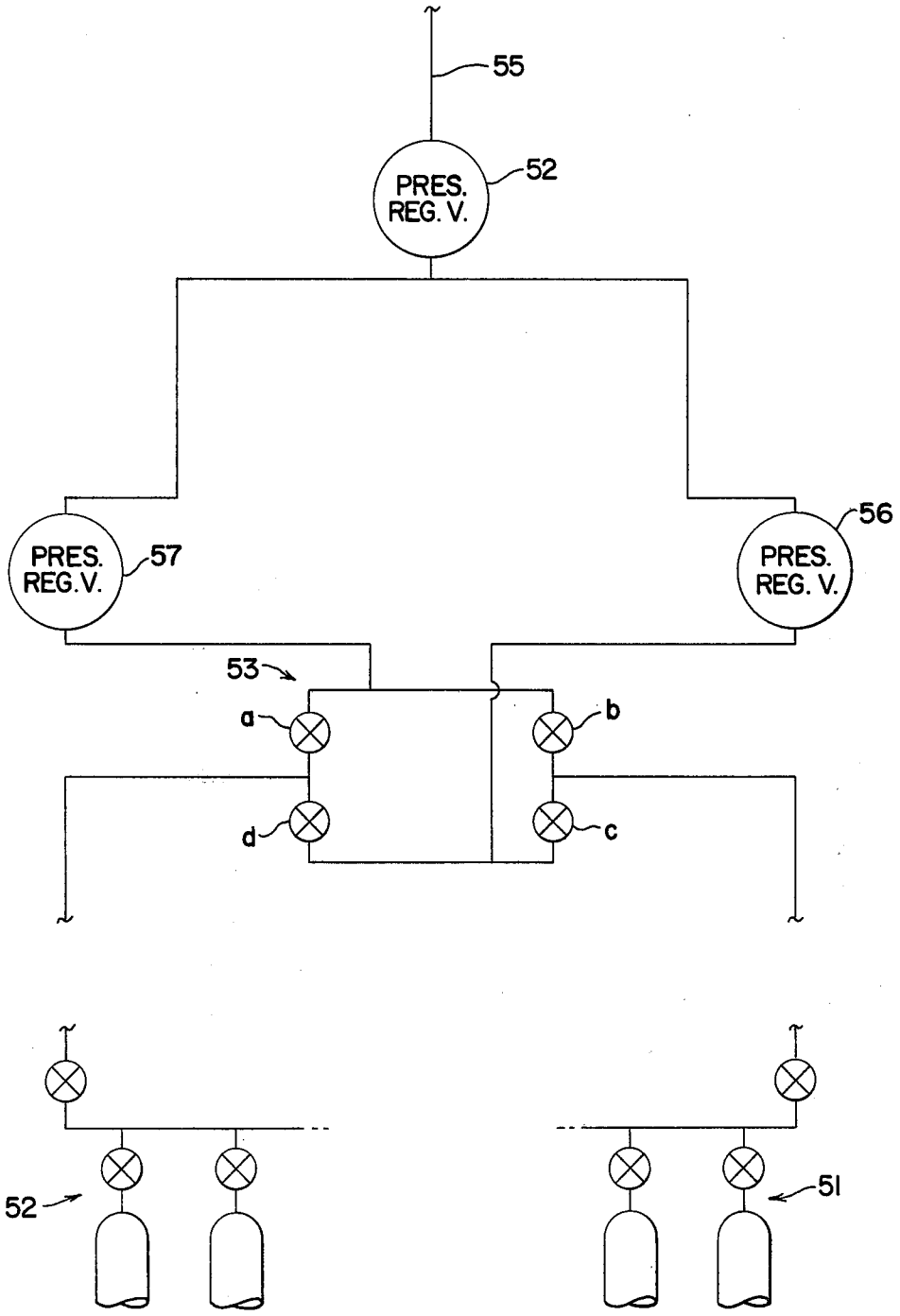
FIG. 4 (PRIOR ART)
Figure 5:
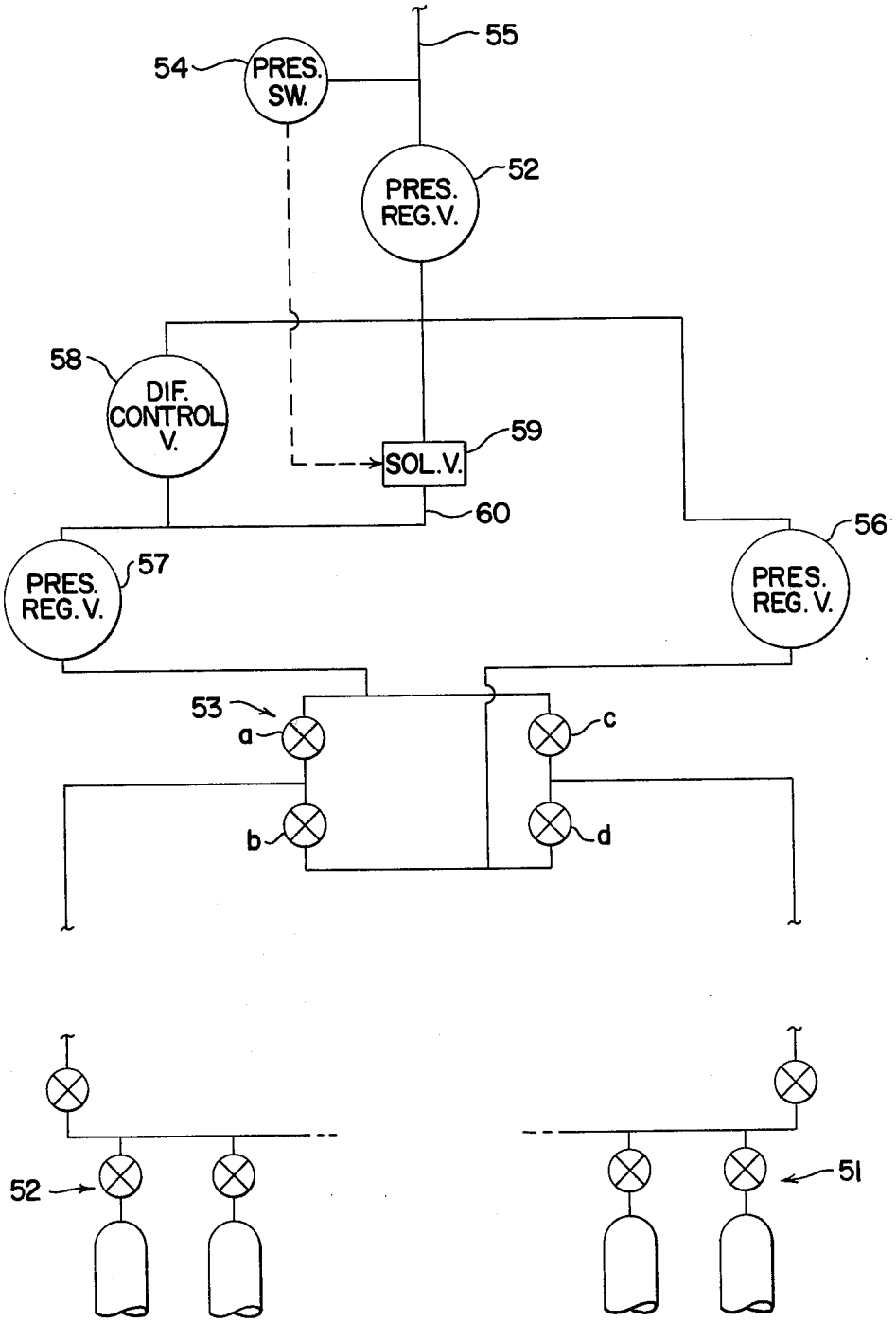
Figure 6:
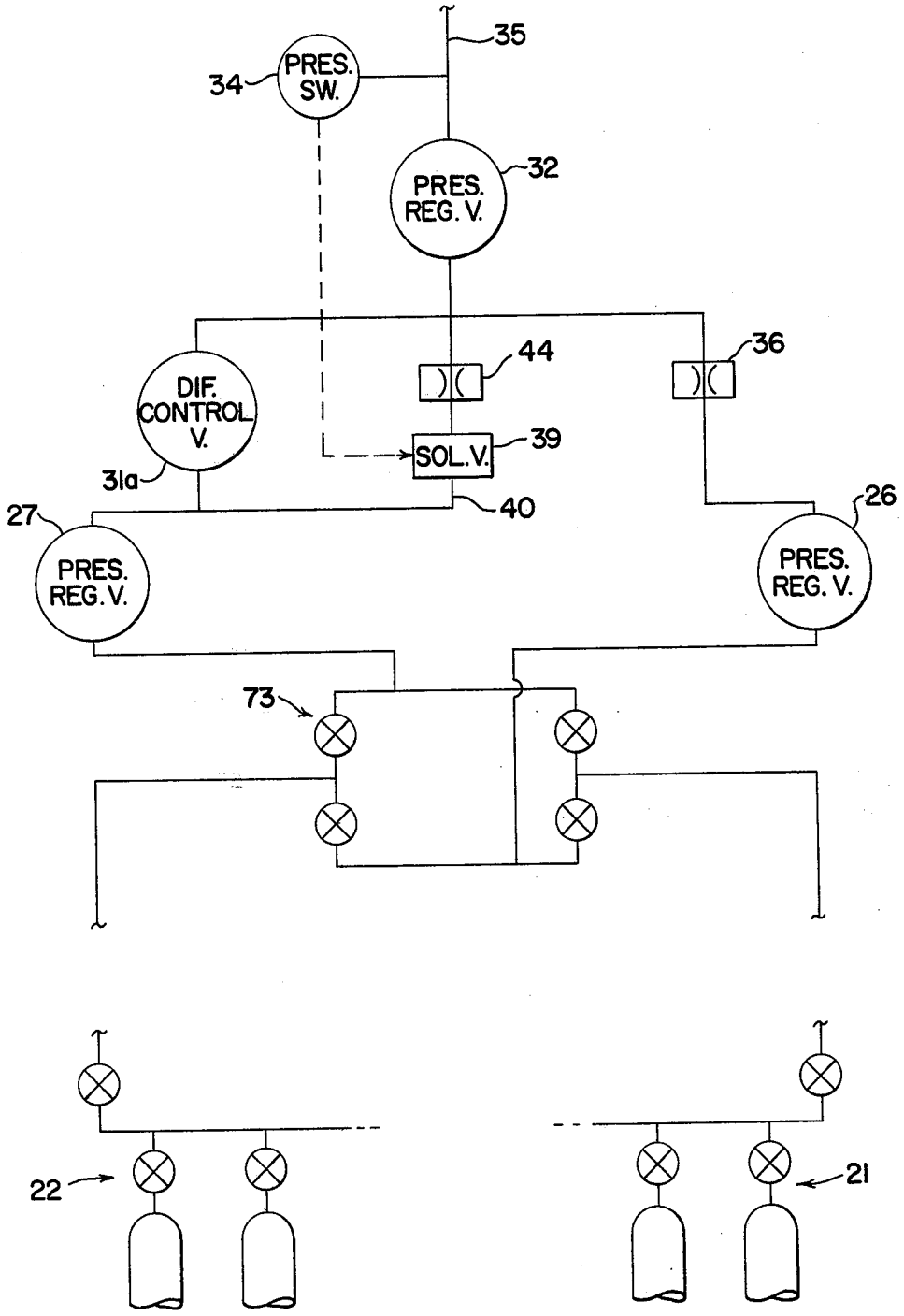
Figure 7:
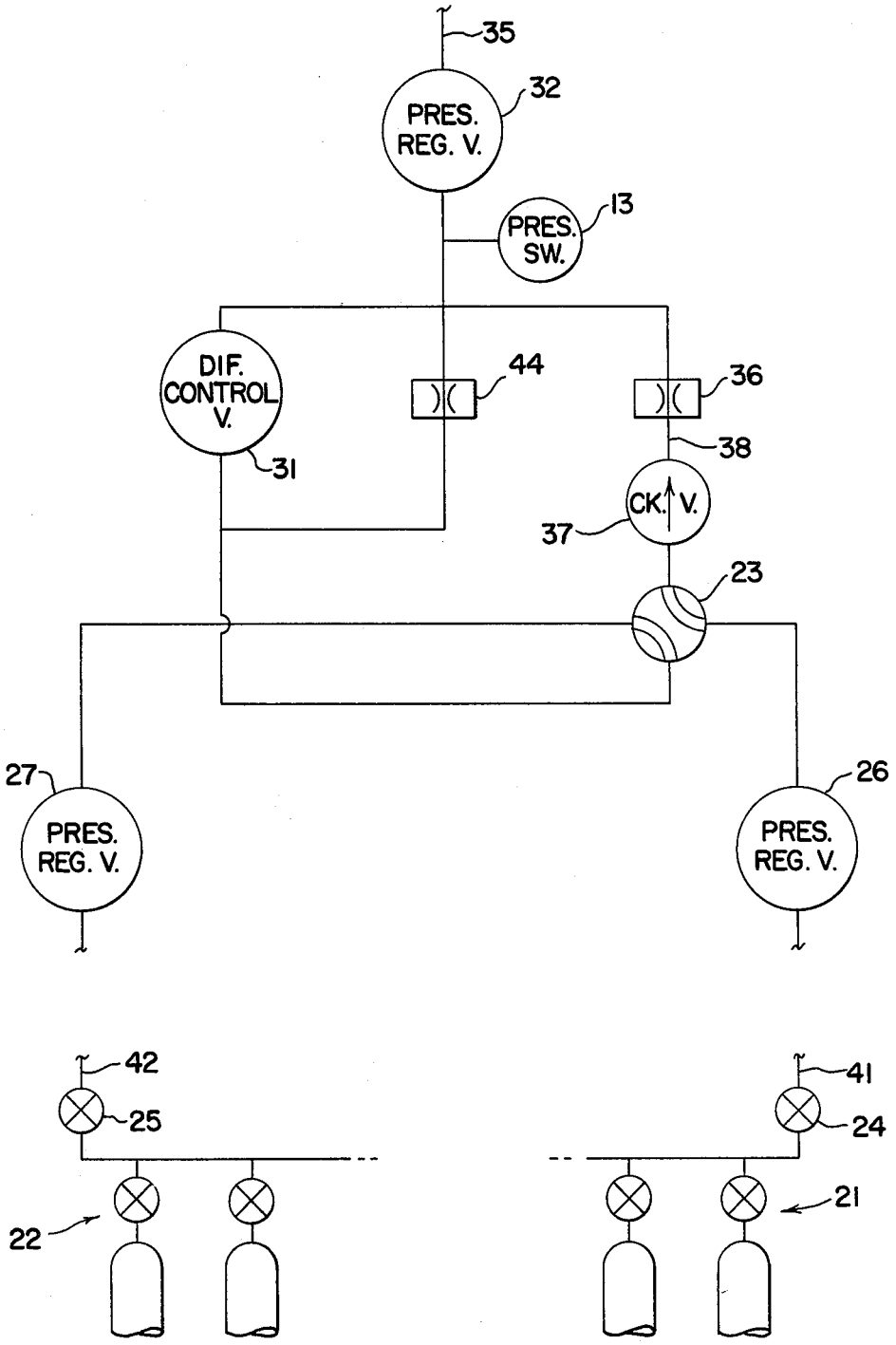
Figure 8:
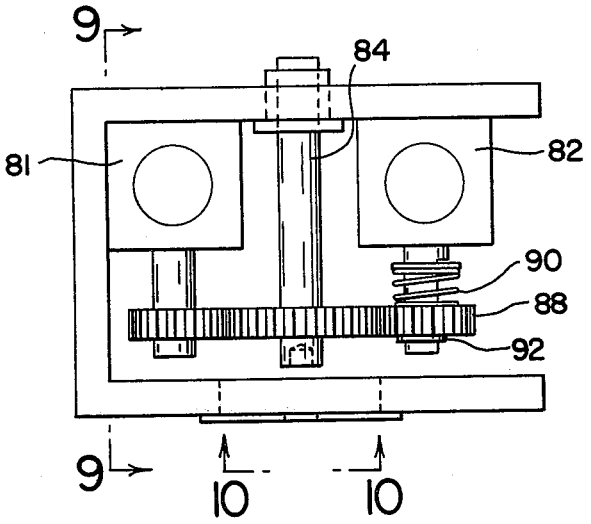
Figure 9:
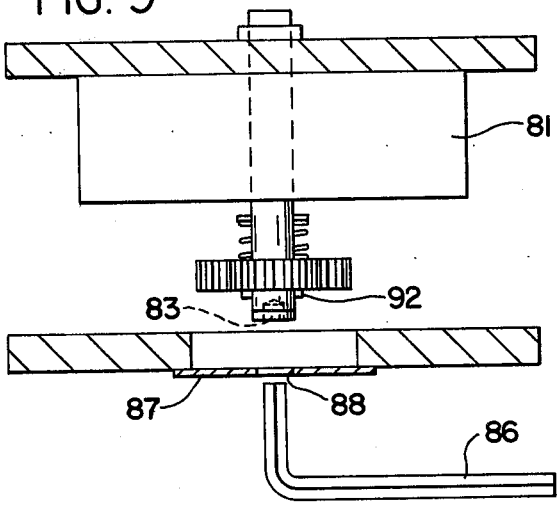
Figure 10:
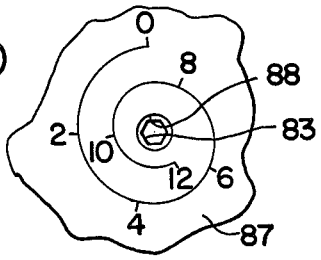

The features and advantages of the invention will be better understood from the following more specific description. In the drawings, FIG. 1 is a schematic diagram illustrating a prior art changeover system which has been manufactured by applicant's assignee and is believed to be as pertinent to the invention as any prior art system. FIG. 2 is a schematic diagram of an example of the present invention. FIG. 3 is a schematic diagram of another example of the present invention. FIG. 4 is a schematic diagram of another type of prior art system. FIGS. 5–7 are illustrations of other examples of the invention. FIG. 8 is a drawing of an example of a proportioner provided by the invention. FIG. 9 is a view taken from the plane of line 9—9 in FIG. 8. FIG. 10 is a fragmentary view taken from the plane of line 10—10 in FIG. 8.

The prior art system of FIG. 1 is included for orientation and in order that the problems of the prior art may be better understood. In such system, the control unit is connected between two banks of cylinders 1 and 2. One bank is selected as the service side, while the other becomes the reserve. This selection is made by manually resetting the three-way valve 3 for receiving gas from either the right bank 1 or the left bank 2. In FIG. 1, it can be seen that the resetting means or three-way valve 3 has been reset so that the right bank 1 becomes the service side.

In operation, the service header valve 4 and the reserve header valve 5 are opened fully. On the service side of the unit, the following happens. High pressure gas enters the service side primary pressure regulator 6 and is regulated down to say 160 psig. It then flows through the three-way selector valve 3 to the line regulator 12, where it is regulated down to say 125 psig in an industrial control or to say 50 psig in a medical control before flowing into the downstream system line 15. In the illustrated system, the service side is also connected through a check valve 8 to the line 10, which is also supplied from the reserve bank 5 via a check valve 8 and a primary pressure regulator 7, the latter being set at the same value as regulator 6, say 160 psig. The check valves 8 prevent loss of pressure from line 10 to either the service or supply side and also act as safety devices to prevent loss of gas to atmosphere in the event of failure of seals in either primary regulator 6 or 7. Gas in line 10 enters the intermediate regulator 11, where it is regulated down to say 140 psig.

At this point, however, any gas entering the intermediate regulator 11 is prevented from passing through it, due to the fact that a pressure of 160 psig exists on the outlet side. The differential pressure on opposite sides of a pressure regulator, in this case the intermediate pressure regulator 11, or on opposite sides of a differential control valve (which is not shown in FIG. 1 because a pressure regulator rather than a differential control valve was used in the prior art device to which FIG. 1 refers), is the heart of the automatic changeover feature of this general type of gas control. It should be noted here that the neutral line 10 does not serve to direct gas into the intermediate regulator 11, but acts as a connection between it and at least the reserve bank. In the illustrated system, the line 10 acts as a common connection between the intermediate regulator and both cylinder banks.

The system will operate to supply gas via the valve 3 as long as there is sufficient gas in the service side of the system to create a pressure differential across the intermediate regulator 11. Once the service side becomes exhausted, the pressure on the service side will fall below 140 psig. When this happens, the intermediate regulator 11 opens, allowing the reserve side of the system to feed the line regulator 12. The automatic changeover cycle is now complete and does not interrupt line pressure or flow.

This illustrated control may incorporate a pressure sensitive switch 13 which monitors the pressure upstream of the line pressure regulator 12. When this pressure decreases to or approaches the setting of the intermediate regulator 11, the pressure switch activates an alarm (not shown). When this occurs, the exhausted supply cylinders 1 are replaced and the three-way valve 3 is rotated to the opposite setting, so that now the reserve side 2 becomes the service side and the entire process repeats itself. Performance of this and other prior art systems is quite satisfactory in controlling and dispensing the permanent gases such as oxygen, argon, nitrogen, etc.

However, when these systems are used to dispense the pressure-stored gases, severe problems arise. In actual operation of this system under moderate to high flows, the service bank cylinders (bank 1 with the three-way valve 3 set as illustrated) become less and less able to provide vapor in proportion to reduction in their wetted surface as the liquid level drops, because the rate of heat absorption correspondingly drops. Also, since this source of heat becomes increasingly inadequate, the temperature of the liquid in the cylinders in tank 1 drops rapidly under sustained draw, further lowering the vaporization rate of which the cylinders of bank 1 are capable.

Thus, with the liquefied gas under moderate to high flow, "service" bank 1 loses its ability to supply sufficient vapor, and pressure upstream of the line pressure regulator 12 drops to the point where control automatically changes over to reserve bank 2. In the event of a protracted shutdown or substantially reduced flow, service bank 1, still containing a substantial amount of liquid, may warm up sufficiently to allow the service side to again overrule the lower differential pressure of the reserve and temporarily assume flow. However, under any but relatively low flow demands, this resurgence of pressure in service bank 1 will not complete vaporization of the liquid in bank 1 during the safe life of reserve bank 2. The user of the manifold system is usually unaware of the remaining unused residual product in supposedly "exhausted" bank 1 at the time when bank 1 must be replaced to perform the "reserve" function after changeover. As a result, when flows required are in the moderate to high range in relation to the number of cylinders employed in the "service" and "reserve" banks, residual liquid returned to the supplier in the cylinders (liquid gas purchased but not utilized) can run as high as 10% of the original content of the cylinder. In addition, the behavior of pressure switch 13 and its associated relay and alarm are frequently erratic and misleading, since indicated "failure" of the service side may occur even though substantial liquid remains in service bank 1.

A system embodying the invention is illustrated in FIG. 2. While the system of FIG. 2 is superficially similar to the system of FIG. 1, its total behavior is quite different.

The system of FIG. 2 actually controls the temperature of the liquid being vaporized in the supply bank, thereby overcoming the difficulties described above which stem from the inability of the liquid gases to acquire sufficient heat for continuing uninterrupted vaporization.

In FIG. 2, a three-way selector valve 23 has been set to select the right bank 21 as the service side. Therefore, this side will of course initially supply any demand that exists in the downstream system line 35. However, the system shown in FIG. 2 controls the temperature of the liquid in this bank by limiting the rate of absorption of heat-of-vaporization by the bank, as will be more fully explained below.

The system shown in FIG. 2 includes header valves 24 and 25, primary pressure regulators 26 and 27 set at say 160 psig, check valves 28 and 29, intermediate pressure regulator 31 set at say 70 psig, and line pressure regulator 32 set at say 50 psig, all arranged in a manner superficially similar to FIG. 1. FIG. 2 also includes a pressure-sensitive switch 34 connected to the downstream line 35, a limiting orifice or flow limiter 36 and a check valve 37 both in the line 38 leading from a three-way selector valve 23, and a solenoid valve 39 in a shunt line 40 which is connected, via the line 30, at least from the acting reserve bank 2, via the elements 25, 27, and 29, and, in the system illustrated, also from the service bank 21 via the elements 24, 26, and 28.

For standard cylinders, the orifice 36 may be selected to allow flow of approximately 10% above the average flow requirement of the system, while limiting the rate of withdrawal from the service bank to slightly above the normal constant withdrawal rate per cylinder for the particular gas. Obviously, the total number of cylinders in banks 21 and 22 is governed by the total flow requirements of a specific application.

The effect of this arrangement is to prevent the temperature of the liquid in the service bank 21 from dropping to a level where vapor failure ("chill out") could occur. It will become apparent, however, that the rate of flow allowed by the limiting orifice 36 will be well below the maximum flow capacity of the system.

When system demand exceeds the rate of flow allowed by the limiting orifice 36, the system will cope with the situation as follows. The pressure switch 34 monitors line (delivery) pressure. When flow demand exceeds the rate established by the limiting orifice 36, a drop in line pressure soon starts to occur. The pressure switch 34 reacts within one pound of drop in line pressure and actuates the normally closed solenoid valve 39 providing direct access of the 160 psig pressure within the common conduit 30 directly to the line regulator 32. Provision of this pressure allows the line regulator 32 to instantly eliminate the small (less than one pound) system pressure drop in system line 35, and the system can now provide the maximum rated flow capacity of the unit. The instant that system demand again drops to within the maximum flow allowed by the limiting orifice 36, all flow will again be assumed by the service bank 21. It is apparent that the quantity of gas removed from the reserve side must be controlled to retain a safe reserve bank capacity. During periods when the bypass is open, it is desirable to retain the same per cylinder withdrawal rate from the service bank which its flow limiting orifice provided before opening of the bypass. Since the pressure in both the service conduit 30 and the bypass are equal and the flow from the reserve side to the bypass is unrestricted, the dominant flow would be through the bypass, thus reducing the rated flow of the service limiting orifice 36. To regulate this and maintain such rate flow, a limiting orifice 44 is also provided in the bypass conduit 40 immediately upstream from its juncture with the intermediate pressure area (the conduit connecting intermediate regulator and line regulator). While nominally of the same size as limiting orifice 36 in the service conduit 30, the size of the bypass orifice 44 may be varied to control the amount of remaining contents of the reserve bank at the time when the service bank is exhausted. It is to be noted that during the high flow period, when additional gas to meet the high system demand is provided from the reserve bank 22, approximately a third of the total high flow will still be provided from the service bank 21, since both the reserve gas and the service gas have available pressures of 160 psig.

In this connection, it is to be noted that the properly selected flow restrictor 36 limits flow to a rate corresponding to somewhat less than the cylinder heat requirement for the service bank cylinders at that flow, thereby allowing a margin for "reserve heat" acquisition while flowing. In the described example, the rate of flow allowed by the restrictor 36 may correspond to about 82% of the cylinder heat requirement of bank 21.

An example of the invention has been described above using a three-way control valve and an intermediate pressure regulator, since such items were used in the prior art system of FIG. 1 and it was desired in FIG. 2 to introduce as few variants as possible in order to most clearly bring out significant differences between the invention and the prior art. However, a more preferred example of the invention is shown in FIG. 3, in which like elements are numbered as in FIG. 2. In FIG. 3, the three-way valve 23 of FIG. 2 is replaced by a four-way valve 23*a*, and the common conduit 30 is eliminated. Intermediate pressure regulator 31 of FIG. 2 is replaced by differential control valve 31*a*, and the check valves 28 and 29 of FIG. 2 are eliminated. The differential control valve 31*a* may be set to deliver approximately 70 psig to the intermediate pressure area between the control valve 31*a* and the line pressure regulator 32. The primary pressure regulators may again be set to deliver 160 psig, as in FIG. 2.

The two conduits immediately downstream of the four-way valve 23*a* both remain constant in assignment. Thus, conduit 38 is again always the service conduit, as it was in FIG. 2. However, now the other downstream conduit, the one leading to the differential control valve 31*a*, is always the reserve conduit.

The operation of the example shown in FIG. 3 is very similar to that shown in FIG. 2. When system demand exceeds the rate allowed by limiting orifice 36 and line pressure starts to drop, pressure switch or sensing device 34 reacts within one pound of drop in line pressure and opens solenoid valve 39 providing direct access of the 160 psig pressure available on the reserve side directly to the line regulator 32, thereby instantly eliminating the small pressure drop in line 35, and the system can thus provide the maximum rated flow capacity of the unit. As in the example of FIG. 2, the instant that system demand again drops to within the maximum flow allowed by limiting orifice 36, all flow will again be assumed by the service bank 21.

The orifices 36 and 44 may be selected as in the example of FIG. 2, orifice 36 being selected to allow flow of approximately 10% above the average flow requirement of the system, while limiting the rate of withdrawal from the service bank to slightly above the normal constant withdrawal rate per cylinder for the particular gas, the total number of cylinders in the banks being governed by total flow requirements of a specific application. Again, as in FIG. 2, orifice 44 may be nominally of the same size as orifice 36, or may be varied to control the amount of remaining contents of the reserve bank at the time when the service bank is exhausted. Again, during the high flow period a substantial portion, say a third, of the total high flow will still be provided from the service bank 21. Again, flow restrictor 36 limits flow to a rate corresponding to somewhat less than the cylinder heat requirement for the service bank cylinders at that flow, thereby allowing a margin for "reserve heat" acquisition while flowing and, for example, the rate of flow allowed by the restrictor 36 may correspond to about 82% of the cylinder heat requirement of bank 19.

In addition to their function as described above, the sensing device 34 and solenoid valve 39 contribute another advantage. During the period when the serivce side 21 has been exhausted and all flow must be provided by the reserve bank 22, flows under say 175 cfh will be provided from the reserve bank 22 through the intermediate regulator 31 or differential control 31*a*, which is set to deliver say 70 psig. When system demand exceeds 175 cfh, the sensing device 34 will again actuate the solenoid valve 39, provide 160 psig to the line regulator 32, and make it possible for the system to meet its maximum rated flow.

Thus, it should be apparent that equivalents to the sensing device 34 and the bypass valve 39 controlled thereby could be applied to any conventional automatic differential changeover system with the effect of causing reserve bank performance to equal that of the service bank. This would result in a 10–15% increase in the total flow capabilities of a conventional unit, for example, one in which neither an intermediate pressure regulator nor a differential control valve is used, and changeover is dependent on differential pressure settings between primary regulators. Such a conventional system is shown in FIG. 4 in which 53 is an open-type valving manifold. In FIG. 4, pressure regulators 56 and 57 serve respectively as service regulator and reserve regulator at all times. Switching of banks 51 and 52 between service and reserve is accomplished through the four valves a—d of valving manifold 53. Starting with all valves closed, right bank 51 is placed in service by opening valves a and c. Left bank 52 is routed through open valve a and feeds reserve regulator 57. The outlet sides of both regulators feed line pressure regulator 52. The roles of the banks are reversed by closing valves a—d, replacing the depleted bank which has just been in service, and opening the valves b and d to thereby place bank 52 in service and bank 51 in reserve. Service and reserve regulators differ in the lower setting of the reserve side regulator 57. This lower setting reduces the flow capacity of the reserve side as compared to the service side.

FIG. 5 illustrates the same basic 4-valve control as shown in FIG. 4. The bypass feature of the present invention may be applied to this basic system by resetting the left side regulator (57), which is normally the reserve regulator in FIG. 4, to the same setting as the service regulator, say 160 psig. A bypass line 60, a differential control valve 58, a solenoid valve 59, and a pressure switch 54 are installed as indicated in FIG. 5. As should be understood, the pressure switch 54 detects a line pressure drop (usually less than 1 pound), opens the solenoid valve 59, bypasses the differential control valve 58 and delivers full primary regulator pressure of 160 psig to the line regulator 52, thus bringing the flow capacity of the reserve side up to 100% of the capability of the service side, while maintaining the changeover function of the system, thus increasing the true flow rating of the system.

FIG. 6 illustrates a system similar to that of FIG. 3, except that an open type valving manifold 73 is employed as the resetting means, rather than the four-way valve 23*a* of FIG. 3 (or the three-way valve 23 of FIG. 2). Like elements in FIG. 6 are given the same reference numerals as in FIG. 3. It is believed that the operation of the system of FIG. 6 will be evident from the description of the operation of the system of FIG. 3, the only essential difference being the accomplishment of resetting by the valving manifold 73 rather than the four-way valve 23*a* of FIG. 3. It will also be understood that FIG. 6 represents a modification of a prior art open-type system and as shown in FIG. 4 by the addition of the differential control valve 31*a*, the bypass line 40, the sensor or switch 34 and valve 39. Even as so modified the system represents a substantial improvement over the system of FIG. 4, but the further provision of restrictor 36 is highly advantageous and the still further provision of restrictor 44 is also advantageous.

For some gases such as nitrous oxide and carbon dioxide, suitable heating means is used. Preferably, there is provided a dual coil heater 23 (FIG. 3) of the type shown in my copending application Ser. No. 851,179, filed Nov. 14, 1977 now abandoned. In such case, the header lines 41 and 42 may be connected to the primary regulators 26 and 27 via loops 41*a* and 42*a* rather than being directly connected. Liquefied fuel gases and other liquefield gases having relatively low vapor pressures do not require provision of a heater.

For gases such as nitrous oxide and carbon dioxide, a system such as shown in FIG. 3 or the other similar examples of the invention will substantially reduce failure of regulator components, i.e., seats, diaphrams, etc., due to extremely low temperatures induced by high flow rates.

A system such as shown in FIG. 3 or the other similar examples of the invention will provide flow rates from 50–75% greater than any standard system for a given manifold size. In the initial purchase of a manifold and control system, this reduces the initial cost of the manifold substantially.

Tests have shown that a system such as shown in FIG. 3 can provide an average flow rate, even under constant withdrawal, of 60–80 cfh per cylinder, entirely eliminating all liquid residual and then reducing residual vapor content to less than 2% of the original product purchased.

In the ordinary changeover manifold, the alarm pressure switch would read the pressure drop between the service regulator output pressure of 160 psig and that of the intermediate pressure regulator or differential control valve and actuate the alarm system. However, in the present invention, a corresponding drop in intermediate pressure does not occur at any but very high flows because of the action of the bypass sensing device 34 and solenoid 39, which, if demand exceeds say 175 cfh, will keep intermediate pressure up by reacting to very slight line drop. In the system of the invention, the intermediate regulator may be set to a much lower value, say 70 psig. Since the bypass assembly prevents any large reduction in intermediate pressure, it is not practical to use sensing of intermediate pressure for alarm purposes. The intermediate regulator or differential control valve is set at 70 psig to accomplish another purpose. As long as pressure from the service side can supply 160 psig to the limiting orifice, true changeover will not occur. When system demand exceeds the capacity of the limiting orifice, the bypass will compensate and restore normal intermediate pressure. At such time that all liquid will have been removed from the service bank cylinders and vapor pressure drops below 160 psig, the service side will continue to flow as long as system demand does not exceed the available pressure from the service bank, down to approximately 70 psig. Thus, down to 70 psig the service bank may provide 100% of supply. Down to this point of 70 psig, any system demand above the flows provided by the existing pressure supplied by the service bank will still cause opening of the bypass and provision of reserve gas to meet the higher need. When the pressure provided by the service bank falls below 70 psig (equivalent to approximately 175 cfh flow capability), true changeover will occur. This places the intermediate regulator 31 or differential control valve **31*a*** in control whenever demand does not exceed 175 cfh. When system demand exceeds 175 cfh, the sensor will again detect a drop of less than one pound line pressure and supply any system requirement up to the rating of the unit from the reserve bank.

After changeover has occurred, the service side will still flow should warm-up of vapor still contained in that bank create a pressure rise above 70 psig (the delivery setting of the intermediate regulator or differential control valve). Therefore, under normal conditions, the service bank will always have a final residual vapor content equal to about 70 psig at ambient temperature.

Stated another way, the requirement of conventional systems for a relatively narrow differential is removed by the function of the bypass or bleed via valve 39. The intermediate regulator or differential control valve may therefore be set to a far lower pressure than in prior systems. True changeover will only occur after all liquid has been withdrawn from the service bank and system demand drops below the capability of the intermediate regulator or differential control valve (approximately 175 cfh at a setting of 70 psig) to meet system demand. It can be seen that any system demand below 175 cfh would be supplied by the service bank at any time the residual vapor pressure exceeds 70 psig. Therefore, the system, through this function of the intermediate regulator or differential control valve, will remove more vapor product from the exhausted service bank than any other automatic changeover system.

The alarm system of the invention senses pressure in the service bank. The pressure switch sensor 33 reads pressure in the service line at a point between the resetting means 23 or **23*a* and the back flow check valve 37**. It may be set at approximately 75 psig. In effect, the alarm thus announces the time to replace the "empty" service bank whose pressure has now been reduced to a relatively low value.

Important advantages of the invention may be realized without use of any feedback control arrangements such as the pressure switches 34 or 54 and solenoid valves 39 or 59. Thus, apparatus such as shown in FIG. 7 may be employed which has no such feedback control arrangement but which is otherwise like the system of FIG. 3.

In FIG. 7 the primary pressure regulators 26 and 27 are each set at say 160 psig and the differential control valve 31 is set to deliver say 140 psig. The flow restrictor 36 in the service conduit is selected or set to allow a flow equal to say 43 cfh per cylinder (from the service side) and the flow restrictor 44 contained in the reserve bypass is selected or set at a flow equivalent to say 40% of the flow allowed from the service side (example: a 4-cylinder manifold is set at 86 cfh from the service side and say 34 cfh from the reserve side). It is apparent that the proportions selected or set are absolute as long as the service bank is able to provide 160 psig to the line regulator. Changeover occurs at the time the service bank is exhausted and intermediate pressure falls to 140 psig, exactly as in the prior art apparatus of FIG. 1 or, more strictly speaking, exactly as in a four-way valve type system that is otherwise equivalent to the three-way valve type system of FIG. 1. However, after changing to reserve, flow rate through the restrictor 44 increases from 34 cfh to a higher flow due to the 20 psig reduction in the downstream pressure (160 psig down to 140 psig), since the restrictor 44 still receives 160 psig from the reserve primary regulator. Any additional system requirement is met by normal reserve flow through the differential control valve. Since the maximum flow rating for a four-cylinder manifold is say 120 cfh, this rate is easily met whether the unit was functioning from either the service or reserve bank.

The modification illustrated in FIG. 7 accomplishes all of the features of the FIG. 3 system except reduction of vapor pressure in the empty service bank cylinders to say 70 psig. In this version, the residual vapor pressure would be 140 psig. Since production costs of accomplishing performance comparable to that of the system of FIG. 3, but with the single exception just noted, may be approximately one-fifth the cost of the full system of FIG. 3, it may well be that the FIG. 7 version may be economically preferable in many applications.

Pressure switch 13 is provided in the apparatus of FIG. 7 for actuating an associated relay and alarm. However, operation of this switch is not subject to the high degree of erratic operation discussed above in connection with the prior art system of FIG. 1 because of the superior exhaustion of the liquid contents of the service bank in the apparatus of FIG. 7.

Different orifice sizes are called for for systems of different flow requirements. Accordingly, in commercial practice, the orifices 36 and 44 may be provided in the form of adjustable metering valves whose settings can be set according to the system flow requirement, so that a number of orifices of different sizes will not have to be made and inventoried, so that manufacturing production of systems of varying capacity, say from 2 to 12 cylinders, may be standardized, and so that if the flow requirement of a system in the field increases, additional cylinders can be readily added without further system modification except for adjustment of the metering valves.

If the orifices are adjusted, the adjustment of orifice 44 must be properly correlated to the adjustment of orifice 36. To accomplish this, a linkage may couple the adjustable metering valves which incorporate the orifices so that a single adjustment readjusts both valves in the properly correlated manner.

The flow capacity of orifice 44 relative to that of orifice 36 controls the maximum percentage of total reserve bank contents which may be withdrawn during the time in which 100% of the contents of the service cylinders is utilized. The coupling of the adjustable metering valves containing the orifices via a mechanical linkage serves to correlate the adjustments of the orifices so as to maintain such maximum percentage at a standard value, say 40%.

However, in some instances, due to special space restrictions or other conditions, it may be desirable to change such maximum percentage (to say 60% or even 80%) contrary to the restraint imposed by the coupling linkage, but thereafter to continue to provide for proper correlation in order to maintain the new maximum percentage in the event of later adjustments to accommodate changed flow requirements.

The invention can accomplish these functions by means such as those illustrated by way of example in FIGS. 8–10. Adjustable metering valves 81 and 82 are provided incorporating respectively the orifices 36 and 44 of FIGS. 2, 3, 6, or 7. The metering valves 81 and 82 are supported in a channel-type housing. The adjusting stems of the valves 81 and 82 are linked to a central adjustment stem 84 by spur gearing, as best seen in FIG. 8. These gears may be inexpensive molded plastic gears or the like, since they serve merely as an adjustment linkage. The stem 84 projects through the front of the housing. An indicator traverses a numbered scale (FIG. 10) as the stem is rotated by a handle or knob, or preferably by suitable keyed access, such as the illustrated socket 83 and wrench 86 (FIG. 9). An access panel or escutcheon plate 87 with a central opening 88 covers the socket 83. The socket and wrench are swaged or otherwise formed so that the wrench will be accepted in the socket in only one relative rotational position; the free end of the wrench is therefore a pointer whose position is a definite function of the degree of opening of the valves 81 and 82. Keyed access is preferred in order to discourage casual adjustments in the field.

The function of this proportioning device is as follows. Due to the fact that the one control will suffice for all manifold sizes from 2 to 12 total cylinder capacity, the metering valve which controls maximum withdrawal from the service cylinder must adjust to numbers corresponding with the number of service cylinders to be used on the manifold for which the control is provided. Thus, the same proportioner can be installed in the control unit of models of all sizes and upon assembly, it can simply be adjusted at the factory to the number of cylinders to be used on that particular manifold size. The parts can then remain in fixed positions.

The second metering valve 82 controls the maximum percentage of total reserve bank contents which may be withdrawn during the time in which 100% of the contents of the service cylinders is utilized. This maximum percentage can be chosen to be say 40% as a standard value. The coupling of the stems of both the metering valves 81 and 82 assures that this 40% will continue to apply for all settings of from 2 to 12 cylinders.

However, since the system of the invention can utilize as much as 80% of the reserve during the life of the service cylinders, and since the best interest of the individual end user of the system can vary widely, a further system of relative adjustment is provided. The driven gear of the second metering valve controlling the amount of reserve product may be taken out of mesh with the driving gear and rotated one or more teeth in either direction to vary the percentages of reserve product, reingaged, and then locked in the new position. It can be seen that if standard units are set at 40% maximum reserve withdrawal, this could be readily changed down to 20% or advanced to 70%.

One way of providing for such adjustment is illustrated. The adjusting stem associated with the valve 81 is provided with a flat to which the associated gear 88 (FIG. 7) is slidingly keyed. A spring 90 biases the gear 88 outwardly on the stem against a gear retained clip 92 to thereby keep the gear in engaged position.

To readjust, finger pressure slides the gear 88 along the stem against the spring bias until the gear is disengaged. The gear 88 may then be manually turned along with the stem one or more teeth in either direction before being released to be reengaged by the biasing of the spring 90.

In the event the manifold which has been in service is increased in capacity in the field by the addition of one or more cylinders to both the service and reserve banks, only the adjustment of the control shaft to the new number by use of the wrench 86 is required to calibrate the control perfectly with the new cylinder capacity.

Either of the changes described can be performed in the field.

It should be evident that this disclosure is by way of example and that many changes may be made by adding, modifying or eliminating details without departing from the fair scope of the teaching contained in this disclosure. For example, the use, in systems lacking an intermediate pressure regulator, of a bypass valve similar to valve 39 and controlled by means similar to sensing device 34 has been described above in connection with the discussion of FIG. 5. As one example of many possible variants of a more specific nature, the differential control valve **31*a* of FIG. 3 could be replaced by an intermediate pressure regulator. However, for safety reasons it is desirable to prevent possible backflow into the primary pressure regulators at all times, so that seal failure will not result in catastrophic loss of all system pressure, and so that a defective regulator can be replaced without shut-down of the system. This is the reason for providing check value 37 in FIG. 2. A differential control valve inherently provides backflow prevention but a pressure regulator does not. Accordingly, if the differential control valve 31*a* of FIG. 3 is replaced by an intermediate regulator, a check valve should be added in the line leading from the four-way valve 23*a***.

The invention is therefore not limited to particular details of this disclosure except to the extent that the following claims are necessarily so limited.

What is claimed is:

1. In a liquefied gas supply system having first and second supply banks and means for replacing spent banks with fresh supply banks and in which system the first and second supply banks alternate in the roles of "service" supply and "reserve" supply to a downstream line fed through a line pressure regulator, and resetting means is provided for effecting the exchange of such roles upon replacement of the supply bank which has most recently been acting as "service" supply, and in which system the bank acting as "service" supply tends to become relatively cold under moderate or relatively high flow demands and the bank acting as "reserve" supply tends to remain relatively warm, flow limiting means for limiting the flow rate from the acting "service" bank to a predetermined level not greatly exceeding the average flow demand of said downstream line to thereby limit the rate of absorption of heat-of-vaporization by the relatively cold acting "service" bank, and means for bleeding makeup gas from the relatively warm acting "reserve" bank so long as such predetermined level is not sufficient to meet demand in said downstream line.

2. In a liquefied gas supply system having first and second supply banks and means for replacing spent banks with fresh supply banks and in which system the first and second supply banks alternate in the roles of "service" supply and "reserve" supply to a downstream line fed through a line pressure regulator, and resetting means is provided for effecting the exchange of such roles upon replacement of the supply bank which has most recently been acting as "service" supply, and in which system the bank acting as "service" supply tends to become relatively cold under moderate or relatively high flow demands and the bank acting as "reserve" supply tends to remain relatively warm, and in which system automatic changeover from "service" supply to "reserve" supply occurs when pressure into the line pressure regulator falls below the delivery setting of an intermediate pressure regulator or differential control valve which is connected from at least the acting reserve bank, means for maintaining desired line pressure in said downstream line prior to changeover, even when system demand exceeds the maximum flow capability from the service bank, by bleeding gas from the relatively warm acting "reserve" bank to the extent required for maintaining said desired line pressure.

3. In a differential changeover liquefied gas supply system having first and second supply banks and means for replacing spent banks with fresh supply banks and in which system the first and second supply banks alternate in the roles of "service" supply and "reserve" supply to a downstream line fed through a line pressure regulator, and resetting means is provided for effecting the exchange of such roles upon replacement of the supply bank which has most recently been acting as "service" supply, and in which system the bank acting as "service" supply tends to become relatively cold under moderate or relatively high flow demands and the bank acting as "reserve" supply tends to remain relatively warm, and in which system automatic changeover from "service" supply to "reserve" supply occurs when pressure into the line pressure regulator falls below the delivery setting of a pressure regulator or differential control valve which is associated with at least the acting "reserve" bank, means effective after changeover to the "reserve" side for automatically bypassing said latter pressure regulator or differential control valve under conditions of high flow demand to thereby allow flow capacity of the reserve side to be increased toward or to equal that of the service side.

4. The invention as in claims 1, 2, or 3, said last-named means comprising a bypass line connected from at least the acting "reserve" bank and having a normally closed bypass valve therein, said pressure sensing and control means for opening the bypass valve when pressure in the downstream line begins to drop below the setting of the line pressure regulator.

5. The invention as in claim 4, said pressure sensing and control means comprising a pressure switch connected to said downstream line and set for actuation upon reduction in pressure in said line to a level just below the setting of the line pressure regulator, the bypass valve comprising a solenoid-controlled valve governed by actuation of the pressure switch.

6. The invention as in claim 2, in which the last-named means permits the acting "service" bank to partially contribute to maintenance of said pressure during said bleeding.

7. The invention as in either claims 2 or 6, including a flow-limiter in series with the relatively cold acting "service" bank for limiting the rate of absorption of heat-of-vaporization by said bank to thereby control the temperature of said bank.

8. The invention as in either claims 2 or 6, including a first flow-limiter in series with the relatively cold acting "service" bank for limiting the rate of absorption of heat-of-vaporization by said bank to thereby control the temperature of said bank, and a second flow-limiter controlling said bleeding of gas from the acting "reserve" bank.

9. The invention as in claims 2 or 6, said bleeding means allowing the setting of said intermediate pressure regulator or differential control valve to a substantially lower pressure setting than the pressure setting of a primary pressure regulator associated with the "service" supply, and thereby allowing the service bank to continue to supply demand down to a residual vapor pressure corresponding to said substantially lower pressure setting so long as and whenever demand does not exceed said maximum flow capability from the service bank, whereby removal of useful vapor product from the depleted service bank is increased.

10. In a liquefied gas supply system having first and second supply banks and means for replacing spent banks with fresh supply banks and in which system the first and second supply banks alternate in the roles of "service" supply and "reserve" supply to a downstream line fed through a line pressure regulator, and resetting means is provided for effecting the exchange of such roles upon replacement of the supply bank which has most recently been acting as "service" supply, and in which system the bank acting as "service" supply tends to become relatively cold under moderate or relatively high flow demands and the bank acting as "reserve" supply tends to remain relatively warm, first flow limiting means for limiting the flow from the acting "service" bank to a predetermined level to thereby limit the rate of absorption of heat-of-vaporization by the relatively cold acting "service" bank, and means for bleeding gas from the relatively warm acting "reserve" bank, said bleeding means including second flow limiting means defining a smaller flow orifice than the first flow limiting means.

11. The invention as in claim 10, said first and second flow limiting means each comprising an adjustable metering valve.

12. The invention as in claim 11, each of said adjustable metering valves having an adjusting stem, linkage means connecting the adjusting stems and constraining them for rotative displacement together.

13. The invention as in claim 12, including means for adjusting the linkage means to change the relative rotative displacement between the stems and then re-establishing said constraint for rotative displacement together.

* * * * *